United States Patent [19]

Spielman

[11] 4,403,947

[45] Sep. 13, 1983

[54] GAS MIXING BURNER

[75] Inventor: Lyle S. Spielman, Rockford, Ill.

[73] Assignee: Eclipse, Inc., Rockford, Ill.

[21] Appl. No.: 292,229

[22] Filed: Aug. 12, 1981

[51] Int. Cl.[3] ..... F23D 15/02

[52] U.S. Cl. ..... 431/353; 431/354; 239/419.3; 239/424.5

[58] Field of Search ..... 431/353, 354; 239/421, 239/424, 424.5, 425, 426, 427.3, 433, 434, 419.3

[56] References Cited

U.S. PATENT DOCUMENTS

| | | | |
|---|---|---|---|
| Re. 26,244 | 8/1967 | Spielman | 263/19 |
| 520,404 | 5/1894 | Axdorfer | 431/353 |
| 2,965,167 | 12/1960 | Campbell | 158/113 |
| 2,965,303 | 12/1960 | Jackson | 239/424.5 |
| 3,044,537 | 7/1962 | Keating et al. | 158/109 |

*Primary Examiner*—Samuel Scott
*Assistant Examiner*—Noah Kamen
*Attorney, Agent, or Firm*—Leydig, Voit, Osann, Mayer & Holt, Ltd.

[57] ABSTRACT

A gas mixing line burner having a stoichiometric turndown ratio in the range of between twenty-five and thirty to one and capable of operating at a capacity of about 2,000,000 BTU/HR per lineal foot of burner. The burner includes an air/fuel manifold having a discharge face which causes combustion air jets to mix with fuel jets and form a main combustible mixture which is provided with a constant ignition source by virtue of stabilizing air jets interacting with the fuel jets and creating a secondary combustible mixture down the center of the main mixture. One embodiment of the burner includes a combustion chamber which is formed by refractory material while the combustion chamber of an alternative embodiment is formed by stainless steel sections connected by expansion joints which prevent warpage of the sections.

13 Claims, 5 Drawing Figures

GAS MIXING BURNER

BACKGROUND OF THE INVENTION

This invention relates generally to a burner and more particularly to a gas mixing line burner.

At the present time, there are three basic types of line burners which are being sold commercially. The first and perhaps oldest type is known as a ribbon burner and is supplied with premixed air and fuel. Approximately sixty percent of the air necessary for combustion is supplied through the burner manifold and ports while the remaining forty percent of the combustion air is picked up from the ambient atmosphere in the vicinity of the burner. The turndown ratio of a burner of this type is in the relatively low order of about three to one. In other words, the heat input at the burner at maximum firing rate is only about three times as great as the heat input when the burner is operated at minimum firing rate. Moreover, a ribbon burner is not useful in airstreams because even the slightest air movement will extinguish the flame. The burner is unable to operate in oxygen deficient atmosphere and thus is not useful in many oven, dryer and furnace applications. The maximum input of such a burner is about 30,000 BTU/HR per lineal ft.

A second type of line burner is a premix burner in which a nearly stoichiometric mixture of air and fuel is supplied to the burner manifold and ports. The burner maintains flame retention by impinging small flame jets off of an ignition retention wall. Usually, the maximum turndown ratio is about eight to one. The minimum input of such a burner is limited because the rate of flame propogation can cause flashback into the manifold. The maximum input of a premix burner is about 400,000 BTU/HR per lineal ft. and is limited by the inability of the burner to maintain flame retention at high mixture pressures and by excessive noise which results from such high pressures. A burner of this type has only limited use in slow moving airstreams and does not lend itself well to high temperature applications.

The third basic type of commercially available burner consists of a fuel manifold or a fuel/air manifold along with a pair of stainless stell mixing plates located on the sides of the manifold. Air is forced through apertures in the mixing plates by a combustion air blower on the burner or is induced to flow through the apertures by air movement in a large duct. While a burner of this type has an excess air turndown ratio which is relatively high, it is incapable of being turned down stoichiometrically. Stated differently, the air and fuel to such a burner cannot be turned down so that only enough oxygen is present for complete combustion of the fuel at all inputs within a wide range of inputs. This type of burner, due to its metallic mixing plates, cannot withstand prolonged exposure to the temperatures normally encountered in furnace applications. In addition, a burner capable of stoichiometric operation is often required. The maximum input of this type of burner is about 1,000,000 BTU/HR per lineal ft.

SUMMARY OF THE INVENTION

The general aim of the present invention is to provide a new and improved gas mixing line burner which is capable of operating in either high or low velocity airstreams, in oxygen deficient environments, and in high temperature furnaces and which, when compared with prior line burners, possesses a significantly higher stoichiometric turndown ratio and is capable of operating with a significantly higher input per lineal foot of burner.

Another object of the invention is to provide a burner which produces a substantially uniform temperature throughout its length so that a single burner extending over the length of a high temperature furnace may be used in place of several small burners and thereby reduce the cost of the installation.

A more detailed object is to achieve the foregoing by providing a burner having a novel air/fuel manifold having a discharge face with uniquely arranged passages which produce a main air/fuel mixture and which cause a secondary air/fuel mixture to exist down the center of the main mixture. The secondary mixture in the center of the main combustible mixture creates a constant ignition source for the main mixture.

A further object is to provide a burner having a combustion chamber formed by plates capable of withstanding extremely high temperatures without warping.

These and other objects and advantages of the invention will become more apparent from the following detailed description when taken in conjunction with the accompanying drawings.

DETAILED DESCRIPTION OF THE PREFERRED EMBODIMENTS

Figure 1:
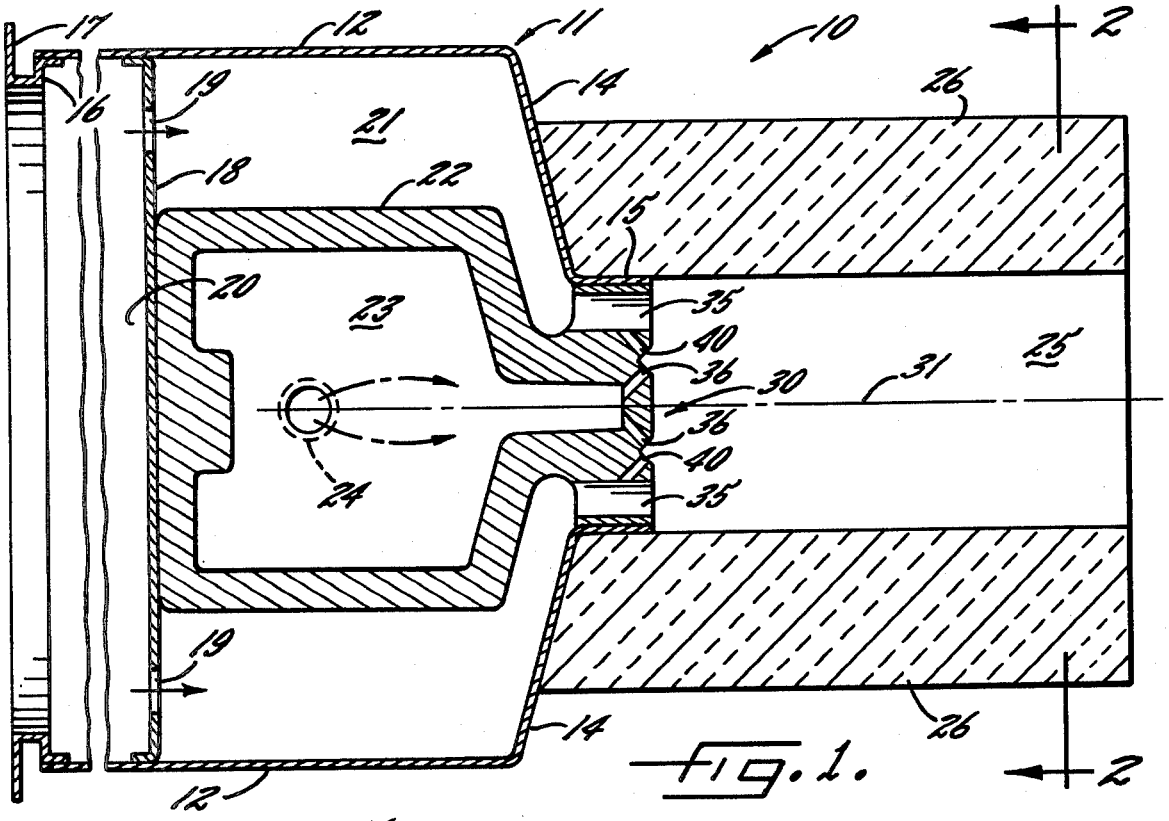
FIG. 1 is a transverse cross-sectional view of one embodiment of a new and improved gas mixing burner incorporating the unique features of the present invention, the view being taken substantially along the line 1—1 of FIG. 2.

As shown in the drawings for purposes of illustration, the invention is embodied in a burner 10 adapted to be used in a furnace or adapted to be positioned in or adjacent to a stream of air or other gas under pressure for the purpose of heating the stream. A burner of this type may be made up of a variety of straight sections to form a straight burner or to form a burner in the shape of a tee or a cross. Being made up of straight burner sections, the burner is conventionally referred to as being a line burner. A straight burner section has been illustrated in the drawings but it should be realized that the burner also could be formed into a circular section.

More specifically, the burner 10 comprises a box-like body 11 made of sheet metal and having a generally rectangular cross-section. The body is defined by top and bottom walls 12 and by two end walls 13, only one of the end walls having been shown. A generally V-shaped front wall 14 is located at the forward margins of the walls 12 and terminates in a forwardly projecting tubular neck 15 of rectangular cross-section. The rear of the body is closed off by a back wall 16. A tubular duct 17 leads into a portion of the back wall and serves to conduct a flow of pressurized air into the body 11.

A distributing plate 18 which is formed with a series of spaced apertures 19 spans the top and bottom walls 12 of the body 11 and extends between the end walls 13. The distributing plate divides the body into a rearwardly disposed air distributing manifold 20 and a forwardly disposed air chamber 21. Air flows from the duct 17 into the distributing manifold 20 and then is evenly metered into the air chamber 21 through the apertures 19 in the distributing plate 18.

Disposed within the air chamber 21 and secured to the distributing plate 18 is an elongated cast iron fuel manifold 22 which defines a fuel chamber 23. Natural gas or other fuel under pressure (e.g., propane or butane) is conducted into the fuel chamber 23 by means of a supply pipe 24 which extends through one of the end walls 13 of the body 11. The fuel manifold divides the air chamber 21 into two sections located above and below the fuel manifold.

Means defining a combustion chamber 25 are telescoped over and secured to the neck 15 of the body 11. Herein, these means are shown as comprising an elongated sleeve 26 made of ceramic or other refractory material and capable of withstanding high temperatures. The sleeve is closed at its ends by ceramic end plates 27, one of which has been shown in FIG. 2. The ceramic sleeve 25 enables the burner 10 to be used in very high temperature furnaces. When the burner is used in oven and various air heating applications, the ceramic sleeve may be replaced by a simple thin-walled sleeve made of temperature-resistant metal.

According to the present invention, the burner 10 is uniquely constructed so as to be capable of being operated at extremely high capacities per lineal foot of burner and, at the same time, to possess a stoichiometric turndown capability which is significantly greater than that of prior burners of the same general type. The foregoing is primarily achieved through the provision of novel mixing means 30 which creates a main air/fuel mixture along the upper and lower sides of the combustion chamber 25 while also creating a secondary air/fuel mixture along the center of the main mixture. The secondary mixture provides a constant ignition source for the main mixture with the resulting interaction of the two enabling the burner to operate at high inputs and with a high stoichiometric turndown ratio.

More particularly, the mixing means 30 herein comprises a generally flat wall integral with the forward end of the fuel manifold 22 and having a centerline 31 which is alined with the centerline of the body 11 and the combustion chamber 25. The wall 30 is telescoped into the neck 15 of the body 11 and is located between the outlet ends of the air and fuel chambers 21 and 23 and the inlet end of the combustion chamber 25.

Two rows of laterally spaced main combustion air passages 35 are formed through the wall 30 and extend between the air chamber 21 and the combustion chamber 25. The two rows of passages are spaced equidistantly from opposite sides of the centerline 31 of the wall 30 with the passages of one of the rows extending from the upper section of the air chamber 21 and with the passages of the lower row extending from the other section of the air chamber. The main combustion air passages 35 are of relatively large diameter and extend substantially parallel to the centerline 31 of the wall.

Figure 3:
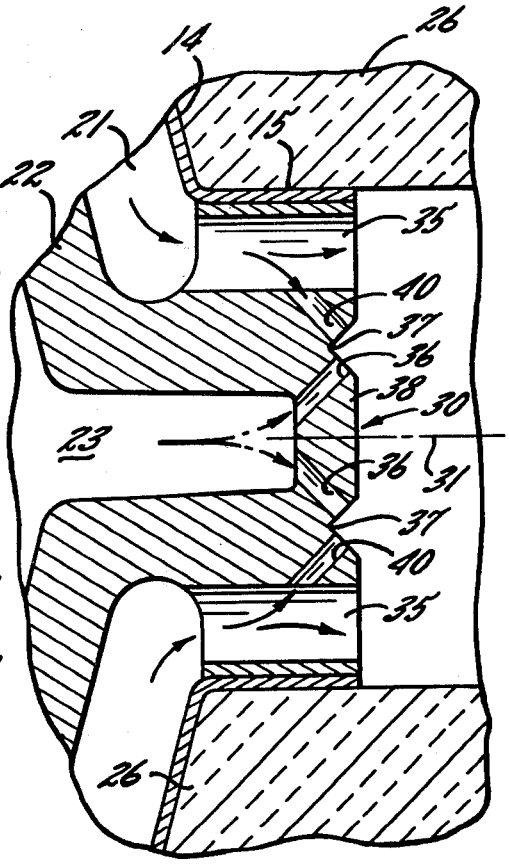
FIG. 3 is an enlarged fragmentary view of the nozzle shown in FIG. 1.

Also formed through the wall 30 are two rows of laterally spaced fuel passages 35 which extend from the fuel chamber 23 to the combustion chamber 25. The rows of fuel passages are located between the rows of combustion air passages 35 and are spaced equidistantly from the centerline 31 of the wall 30. As the fuel passages 36 progress toward the combustion chamber 25, the passages of the two rows diverge symmetrically away from the centerline 31 at a predetermined angle which preferably but not necessarily is about forty-five degrees. The fuel passages 36 exit through the inner walls of a pair of laterally extending and substantially V-shaped grooves 37 (FIG. 3) which are formed in the discharge face 38 of the wall 30, the grooves being spaced equidistantly from the centerline 31.

In keeping with the invention, two rows of laterally spaced air stabilizing passages 40 are formed through the wall 30. The air stabilizing passages 40 of the upper row lead from the upper combustion air passages 35 to the combustion chamber 25 while the air stabilizing passages of the lower row lead from the lower combustion air passages 35 to the combustion chamber. The two rows of air stabilizing passages 40 also are spaced equidistantly from the centerline 31 and, as the passages 40 progress toward the combustion chamber 35, they converge symmetrically toward the centerline 31. In this instance, the passages 40 of each row converge toward the centerline 31 at an angle of about forty-five degrees. The passages 40 exit from the outer walls of the V-shaped grooves 37.

Figure 2:
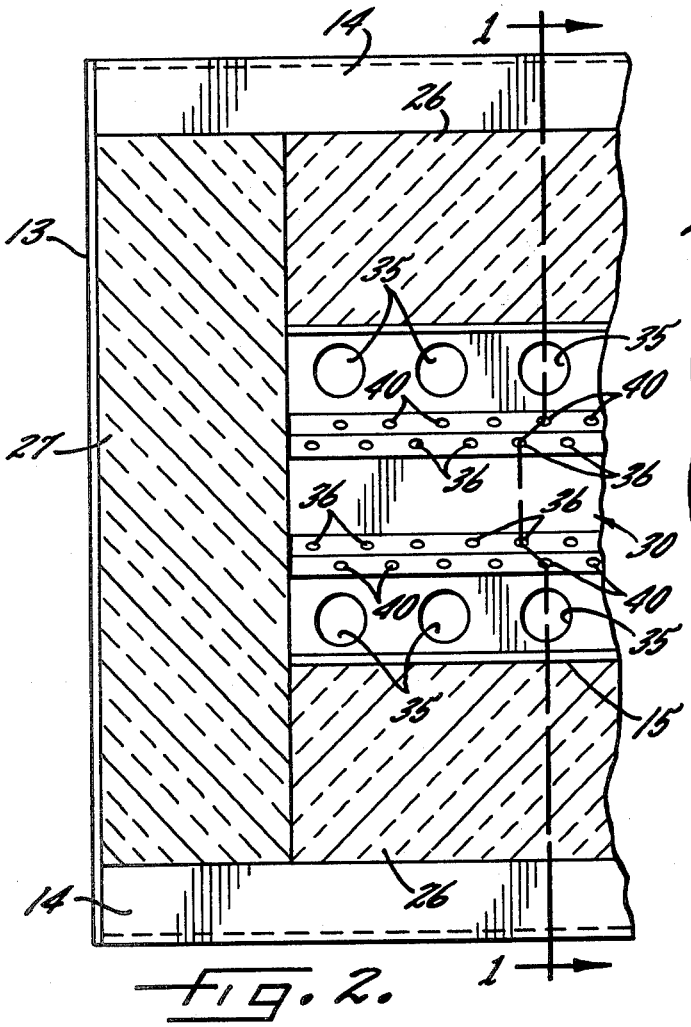
FIG. 2 is a fragmentary cross-sectional view of the burner as taken substantially along the line 2—2 of FIG. 1.

As shown in FIG. 2, the fuel passages 36 and the air stabilizing passages 40 are about the same diameter and are approximately the same in number. The passages are arranged such that an air stabilizing passage 40 is located approximately midway between two adjacent fuel passages 36. The combustion air passages 35 are significantly larger in diameter than the fuel passages 36 with there being approximately twice as many fuel passages as combustion air passages. Each combustion air passage 35 is located about midway between two adjacent fuel passages 36 and, because the combustion air passage is of large diameter, its edges overlap the two fuel passages.

With the foregoing arrangement, the jets of fuel issuing from the fuel passages 36 are picked up by and mixed with the air flowing through the combustion air passages 35 so as to form a main combustible mixture of air and fuel along the upper and lower walls of the combustion chamber 25. At the same time, the jets of air flowing through the air stabilizing passages 40 attract a portion of the fuel issuing from the fuel passages 36 and cause a secondary combustible mixture to exist and stabilize the center portion of the combustion chamber 25. The secondary mixture creates a constant ignition source for the main combustible mixture flowing along the walls of the combustion chamber and promotes efficient and stable combustion of the main mixture.

A burner 10 of the type described has an extremely high stoichiometric turndown ratio in the neighborhood of between twenty-five and thirty to one. Such high turndown capability is maintained when either propane or butane is used as a fuel rather than natural gas, the burner being capable of burning those fuels with a sharp blue flame. The burner is capable of being operated at capacities in excess of 2,000,000 BTU/HR per lineal ft. and will operate in both high and low velocity airstreams as well as in oxygen deficient environments. When the combustion chamber 25 of the burner is formed by refractory material or in the manner described below, the burner may be used in high temperature furnaces and kilns. The burner produces a substantially uniform temperature along its length and thus a long burner can be used in place of several small burners to produce a uniform temperature throughout the length of a furnace.

Figure 4:
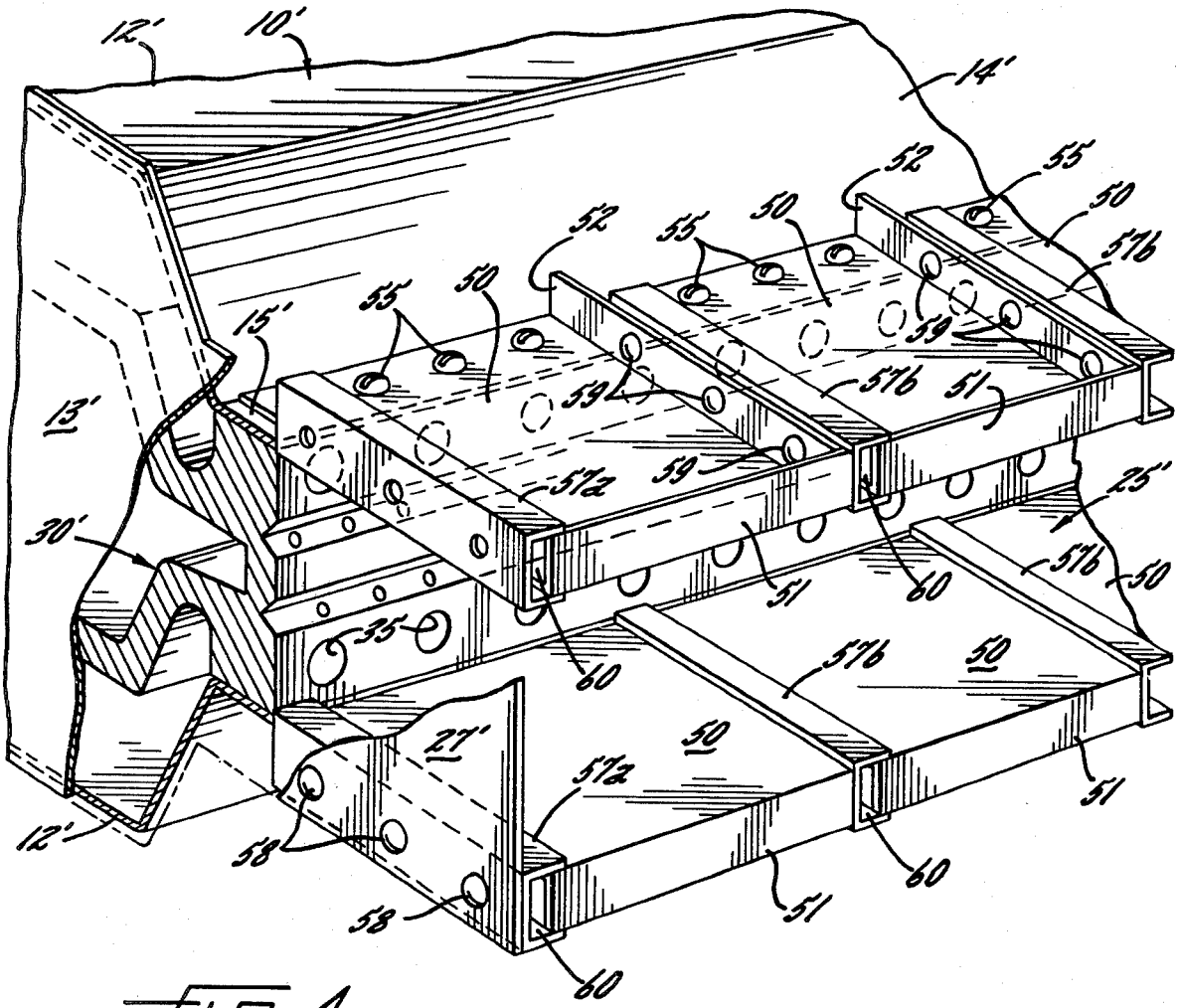
FIG. 4 is a fragmentary perspective view of another embodiment of a burner incorporating the features of the invention.
Figure 5:
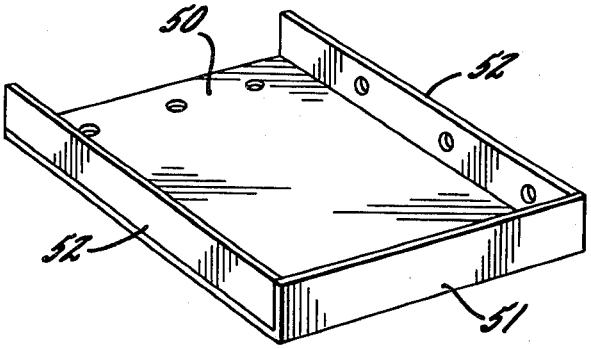
FIG. 5 is a perspective view of a part shown in FIG. 4.

A modified burner 10' is shown in FIGS. 4 and 5 in which parts corresponding to those of the first embodiment are indicated by the same but primed reference numerals. The burner 10' is particularly characterized by the fact that the combustion chamber 25' is defined by a plurality of relatively thin plates 50 made of stainless steel or other temperature-resistant metal and capable of expanding without warping. The plates 50 are less expensive than the ceramic sleeve 26 of the burner 10 and can more easily be adapted to burners of different lengths.

If the burner 10' is relatively short in length, a single plate 50 is located along the upper side of the combustion chamber 25' while another plate is located along the lower side of the combustion chamber. In the burner which has been illustrated, however, several plates 50 are located in rows along the upper and lower sides of the combustion chamber and thus the chamber is formed by multiple sections. The extreme ends of the combustion chamber are closed by metal end walls 27' (only one of which has been shown) which are continuations of the end walls 13'.

As shown in FIG. 5, each plate 50 is flat and rectangular and is formed with a front flange 51 and two side flanges 52. The plates are oriented such that the front flanges project upwardly from the upper plates and project downwardly from the lower plates. The rear edge portions of the plates are secured to the upper and lower sides of the wall 30' by screws 55 which extend through the neck 15'.

In carrying out the invention, each plate 50 is associated with a channel-shaped member 57 which permits the plate to expand laterally without warping when the plate is subjected to high temperatures. Thus, upper and lower channels **57*a* are attached to the inner side of the end wall 27' by rivets 58. Each channel slidably receives one side edge portion of the end plate 50 and also slidably receives the end portion of the front flange 51 of that plate. Accordingly, upon being heated, the metal is free to expand into the space 60 within the channel 57*a*** and thus will not buckle and warp.

When the combustion chamber is defined by multiple sections as specifically shown in the drawings, an additional channel **57*b* is interposed between each pair of adjacent plates 50. A side flange 52 of one plate is riveted to the additional channel 57*b* as indicated at 59** while the side edge portion of the adjacent plate is slidably received in that channel. Thus, the various plates are free to expand relative to one another.

I claim:

1. A gas mixing burner comprising means defining air, fuel and combustion chambers, means for supplying pressurized air and fuel to said air and fuel chambers, respectively, said air and fuel chambers each having an outlet end, said combustion chamber having an inlet end located adjacent the outlet ends of said air and fuel chambers, and mixing means located between the inlet end of said combustion chamber and the outlet ends of said air and fuel chambers, said mixing means comprising a structure having first and second spaced apart rows of combustion air passages leading from said air chamber to said combustion chamber, first and second rows of fuel passages formed through said mixing means between said rows of combustion air passages and leading from said fuel chamber to said combustion chamber, said rows of fuel passages diverging away from one another as such passages progress toward said combustion chamber, a first row of stabilizing air passages formed through said mixing means between said first row of combustion air passages and said first row of fuel passages and leading from said air chamber to said combustion chamber, and a second row of stabilizing air passages formed through said mixing means between said second row of combustion air passages and said second row of fuel passages and leading from said air chamber to said combustion chamber, said rows of stabilizing air passages converging toward one another as such passages progress toward said combustion chamber.

2. A gas mixing burner comprising a body defining an air chamber having an outlet end, means for supplying pressurized air to said chamber, means within said air chamber and defining a fuel chamber having an outlet end, means for supplying pressurized fuel to said chamber, means defining a combustion chamber having an inlet end located adjacent the outlet ends of said air and fuel chambers, and mixing means between the inlet end of said combustion chamber and the outlet ends of said air and fuel chambers, said mixing means comprising a structure having first and second spaced apart rows of combustion air passages leading from said air chamber to said combustion chamber, first and second rows of fuel passages formed through said mixing means between said rows of combustion air passages and leading from said fuel chamber to said combustion chamber, said rows of fuel passages diverging away from one another as such passages progress toward said combustion chamber, a first row of stabilizing air passages formed through said mixing means between said first row of combustion air passages and said first row of fuel passages and leading from the combustion air passages of said first row to said combustion chamber, and a second row of stabilizing air passages formed through said mixing means between said second row of combustion air passages and said second row of fuel passages and leading from the combustion air passages of said second row to said combustion chamber, said rows of stabilizing air passages converging toward one another as such passages progress toward said combustion chamber.

3. A gas mixing burner comprising a body defining an air chamber having an outlet end, means for supplying pressurized air to said chamber, means within said air chamber and defining a fuel chamber having an outlet end, means for supplying pressurized fuel to said combustion chamber, means defining an elongated combustion chamber having an inlet end located adjacent the outlet ends of said air and fuel chambers, and mixing means between the inlet end of said combustion chamber and the outlet ends of said air and fuel chambers, said mixing means comprising a structure having a centerline and having first and second rows of combustion air passages leading from said air chamber to said combustion chamber, said rows being spaced equidistantly from opposite sides of said centerline, first and second rows of fuel passages formed through said mixing means between said rows of combustion air passages and leading from said fuel chamber to said combustion chamber, said rows of fuel passages being spaced equidistantly from said opposite sides of said centerline and diverging symmetrically away from said centerline as such passages progress toward said combustion chamber, a first row of stabilizing air passages formed through said mixing means between said first row of combustion air passages and said first row of fuel passages and leading from the combustion air passages of said first row to said combustion chamber, and a second row of stabilizing air passages formed through said mixing means between said second row of combustion air passages and said second row of fuel passages and leading from the combustion air passages of said second row to said combustion chamber, said rows of stabilizing air passages being spaced equidistantly from said opposite sides of said centerline and converging symmetrically toward said centerline as such passages progress toward said combustion chamber.

4. A gas mixing burner as defined in claim 3 in which said combustion air passages extend substantially parallel to said centerline.

5. A gas mixing burner as defined in either of claims 3 or 4 in which said fuel passages diverge away from said centerline at the same angle at which said stabilizing air passages converge toward said centerline.

6. A gas mixing burner as defined in claim 5 in which said angle is approximately forty-five degrees.

7. A gas mixing burner as defined in claim 3 in which the number of air stabilizing passages is approximately equal to the number of fuel passages, each of said air stabilizing passages being located substantially midway between two adjacent fuel passages.

8. A gas mixing burner as defined in claim 7 in which there are approximately twice as many fuel passages as combustion air passages, each of said combustion air passages being located substantially midway between two adjacent fuel passages and overlapping such fuel passages.

9. A gas mixing burner as defined in claim 3 in which said mixing means comprises a discharge face having first and second substantially V-shaped grooves spaced equidistantly from said opposite sides of said centerline and located inwardly of said first and second rows of combustion air passages, said fuel passages exiting through the inner walls of said grooves, and said stabilizing air passages exiting through the outer walls of said grooves.

10. A gas mixing burner as defined in claim 3 in which said means defining said fuel chamber divide said air chamber into first and second sections, said first and second rows of combustion air passages communicating with said first and second sections, respectively.

11. A gas mixing burner as defined in claim 3 in which said means for defining said combustion chamber comprise a sleeve made from ceramic material.

12. A gas mixing burner as defined in claim 3 in which said means defining said combustion chamber comprise flat metal plates located on opposite sides of said combustion chamber, and channel members attached to said body and slidably receiving edge portions of said plates to permit said plates to expand.

13. A gas mixing burner as defined in claim 12 in which a first row of said plates is located on one side of said combustion chamber and in which a second row of said plates is located on the opposite side of said combustion chamber, and a channel member located between each pair of adjacent plates and secured to one of said plates while slidably receiving the other of said plates.

* * * * *